US006309309B1

(12) United States Patent
Beach et al.

(10) Patent No.: US 6,309,309 B1
(45) Date of Patent: Oct. 30, 2001

(54) OVERSIZED IRON-TYPE GOLF CLUB

(75) Inventors: Todd P. Beach, San Diego; Bret Wahl, Carlsbad, both of CA (US)

(73) Assignee: Taylor Made Golf Company, INC, Carlsbad, CA (US)

( * ) Notice: Subject to any disclaimer, the term of this patent is extended or adjusted under 35 U.S.C. 154(b) by 336 days.

(21) Appl. No.: 08/853,651

(22) Filed: May 9, 1997

(51) Int. Cl.[7] ..... A63B 53/04; A63B 53/10
(52) U.S. Cl. ..... 473/290; 473/319; 473/350
(58) Field of Search ..... 473/319, 350, 473/290, 287

(56) References Cited

U.S. PATENT DOCUMENTS

| | | | | |
|---|---|---|---|---|
| 4,097,626 | | 6/1978 | Tennent . | |
| 4,471,961 | | 9/1984 | Masghati et al. . | |
| 5,018,735 | * | 5/1991 | Meredith | 473/318 |
| 5,076,585 | | 12/1991 | Bouquet . | |
| 5,093,162 | | 3/1992 | Fenton et al. | 428/34.5 |
| 5,094,457 | | 3/1992 | Kinoshita . | |
| 5,172,913 | | 12/1992 | Bouquet . | |
| 5,265,872 | | 11/1993 | Tennent et al. . | |
| 5,308,062 | * | 5/1994 | Hogan | 473/319 |
| 5,333,859 | * | 8/1994 | Teramoto | 473/290 |
| 5,388,826 | * | 2/1995 | Sherwood | 473/290 |
| 5,401,021 | * | 3/1995 | Allen | 473/291 |
| 5,573,467 | | 11/1996 | Chou et al. . | |

* cited by examiner

*Primary Examiner*—Jeanette Chapman
*Assistant Examiner*—Stephen L. Blau
(74) *Attorney, Agent, or Firm*—Knobbe, Martens, Olson & Bear, LLP

(57) ABSTRACT

A golf club, particularly adapted for use with an oversized iron-type head including an iron-type head and a shaft particularly adapted to overcome the droop effect and increase stability upon off-center impact. The iron-type head defines a sole portion, an impact face, a back portion and a hosel extension defining an opening. The shaft has a butt portion and a tip portion. The tip portion has a substantially straight profile and defines an outer diameter d greater than or equal to 0.38 inches and less than or equal to 0.40 inches (i.e., 0.38 inches$\leqq$d$\leqq$0.40 inches). The shaft has a weight W less than or equal to 85 grams (W$\leqq$85 grams). At least a part of the tip portion is positioned within the opening of the head. Desirably, the tip portion has a length of greater than or equal to 2 inches.

9 Claims, 5 Drawing Sheets

OVERSIZED IRON-TYPE GOLF CLUB

BACKGROUND AND SUMMARY OF THE INVENTION

1. Field of the Invention

This invention relates to an iron-type golf club and, more particularly, to an oversized iron-type golf club.

2. Description of Background and Related Art

There are a multitude of golf club designs, utilizing a wide variety of shafts and golf club heads. U.S. Pat. No. 5,039,162 to Fenton discloses a composite golf club shaft having a standard butt diameter, and an oversized tip diameter. By convention, and for purposes of this disclosure, tip diameter is the outer diameter of the shaft measured at the location just outside of the hosel opening. A standard shaft has a tip diameter of approximately 0.37 inches. Fenton teaches combining standard modulus of elasticity carbon fiber material with at least one ply of fiberglass to increase the diameter of the shaft tip. The resultant shaft tip has a diameter between 0.400 and 0.440 inches. The glass fiber is indicated to be desirable because it has a lower cost than carbon fiber. Undesirably, however, the weight of the shaft is increased significantly without a substantial increasing of the stiffness of the shaft.

Another prior art shaft design is disclosed in U.S. Pat. No. 5,265,872 to Tennent. Tennent discloses a composite golf club shaft having a base rod and a flared tip portion. Tennent teaches that the flared tip portion in the club will reduce breakage at the hosel region. On the other hand, the shaft design of Tennent is undesirable in that it is difficult to manufacture compared to a shaft having a conventional profile. The Tennent shaft is further undesirable in that it is difficult to manufacture shafts of this configuration with a consistent stiffness distribution in that the particular progression of the shape and the shaft can effect shaft deformation and consistency. The Tennent shaft is also further undesirable for a flared butt shaft construction. Flared butt shafts provide the advantage of lightening the upper potion of the shaft while achieving the same stiffness as a conventional shaft. Tennent's combination of a flared tip and a flared butt, however, would require the use of a separate mold for each shaft length as the ends of the shaft could not be cut without affecting the shafts' consistency within the set.

For some time, golf club manufacturers have combined oversized metalwood heads with composite shafts. These clubs are easier to hit than the conventionally designed woods that they replaced. The reason is two-fold. First, by enlarging the head, the sweet spot of the club face is enlarged. Second, the composite shaft is generally lighter than a conventional steel shaft, and therefore, can be swung more quickly with the same amount of force generating greater club head speed and, therefore, greater ball velocity.

Since the combination of oversized metalwood heads with composite shafts is so beneficial, many club manufacturers have combined oversized ironheads with composite shafts. As with the case for oversized woods, the desired effect is an iron that is less sensitive to off-center hits and generates greater ball velocity.

Applicant has determined, however, that the increase in the iron-type head volume is typically accompanied by displacement of the center gravity of the club head. Specifically, when the volume of the club head increases, the center of the gravity tends to shift away from the shaft axis. This occurs even when the mass of the club head remains the same as that of a standard iron head. Applicant has further determined that the shifting of the center of gravity further from the shaft axis causes the ironhead to droop when swung in a conventional manner. This droop effect is created by the centrifugal force acting through the center of gravity of club head during the swing. This force creates a bending moment on the tip of the shaft, which causes the club head to droop downward, so that the toe of the club face will be lower than the heel at time of impact with the ball. This can lead to one of two results. One, the misaligned club head can strike the ground prior to hitting the ball. Alternatively, the leading edge of the club, rather than the impact face, can strike the ball. Neither result will be appreciated by the golfer.

FIG. 1 illustrates the change in the position of the center of gravity (from 1 to 2) due to the use of an oversize head. The desired position of the iron with respect to the ball is shown in phantom. The oversize iron incorrectly positioned because of the droop effect is shown in solid lines. Droop effect occurs in standard irons but not to the extent that it occurs in oversized iron heads. This is because the shift of the center of gravity magnifies the droop effect in an oversized head.

Accordingly, one aspect of Applicant's invention is an improved golf club, particularly adapted for use with an oversized iron-type head including an iron-type head and a shaft particularly adapted to minimize the droop effect. The iron-type head defines a sole portion, an impact face, a back portion and a hosel extension defining an opening. The shaft has a butt portion and a tip portion. The tip portion has a substantially straight profile and defines an outer diameter d greater than or equal to 0.38 inches and less than or equal to 0.40 inches (i.e., 0.38 inches $\leqq d \leqq 0.40$ inches). The shaft has a weight W less than or equal to 85 grams ($W \leqq 85$ grams). At least a part of the tip portion is positioned within the opening of the head. Desirably, the tip portion has a length of greater than or equal to 2 inches and less than or equal to 11 inches. Desirably, the tip portion defines a substantially straight and continuous profile of the fiber layers with no area of abrupt variation of diameter to prevent risks of weakened area or breakage area.

Another aspect of the invention is a golf club including an oversized iron-type head and a shaft. The head defines a sole portion, an impact face, a back portion and a hosel extension defining an opening. The impact face has an area of greater than or equal to 3200 $mm^2$. A shaft has a butt portion and a tip portion. The tip portion has a substantially straight profile and defines an outer diameter greater than or equal to 0.38 inches and less than or equal to 0.40 inches. The shaft desirably comprises a single type of fibrous material and at least a part of the tip portion is positioned within the opening of the head. Advantageously, the fibrous material comprises carbon fibers, preferably carbon fibers having a standard modulus of elasticity. In its preferred embodiment, the golf club provides a light weight shaft having increased resistance to droop effect and greater torsional strength to avoid twisting of the golf club head at impact. Desirably, the shaft has a substantially straight tip portion comprised of a single composite material so that the stress distribution of the club is easily controlled and reproducible. Further, this permits various irons to be manufactured from a standard shaft which is then cut to the desired length before assembly.

An attempt to combine an oversized wood-type head whose volume is 220 cc or greater with a shaft having an enlarged tip between 0.37 to 40 inches was disclosed in the U.S. Pat. No. 5,573,467 to Chou. This combination is allegedly made for the purpose of improving the performance of the club; and in particular for increasing distance.

But, this disclosure is substantially different from the present invention in the fact that Chou is limited to a wood-type club. The recognized standard for tip diameter for a wood has always been considered to be different; and more precisely less, for a wood than for an iron. For wood clubs, the tip standard is 0.335 inches while for the iron club the tip standard is 0.370 inches. Therefore, it is not intuitive to transpose the teaching of the Chou patent directly to an iron-type golf club since it has been recognized by the art that woods and irons should be manufactured according to different design criteria.

In addition, the Applicant has determined that an iron-type club performs substantially different than a wood-type golf club. In particular, an iron requires more stability when the ball impacts the club near the toe than a wood.

As illustrated in FIGS. 2 and 3, when a wood strikes a ball at the toe, the ball is still driven a relatively large distance and in the direction of the targeted trajectory. This is due to the fact that the center of gravity of a wood is more distant from the impact face than the center of gravity of an iron. This imparts a side spin (ss) on the ball which can be compensated for by properly designed bulge radius (R), but has a less significant result in the loss of ball velocity ($v_w$).

In contrast, as shown in FIG. 3, when an iron strikes the ball at a location offset from the center of gravity toward the toe, the face is twisted backward by the impact a distance M relative to the center of gravity of the head, resulting in a more significant loss of ball velocity ($v_i$). As the iron face becomes larger, the effect can be magnified due to the distance (h) between the potential impact location on the toe and the center of gravity, resulting in a larger moment arm.

In addition to the significant loss of velocity for off-center hits, the iron also has a substantial loss of accuracy due to the deviation angle θ of the ball as it rebounds off the rotated face. Even a very slight rotation of the club during the time the ball is in contact with the impact face, can result in a significant divergence of the trajectory T of the ball from the targeted trajectory $T_o$.

Therefore, an iron-type club requires a shaft which is specifically adapted to prevent the head from rotating during an offset impact with the ball. The Chou patent does not address this issue (even for wood-type clubs). Therefore, there is no particular reason to believe that the teaching of Chou would be useful in solving this problem for irons.

BRIEF DESCRIPTION OF THE DRAWINGS

Other characteristics and advantages of the invention will be better understood through the description which follows, with reference to the accompanying drawings, illustrating a preferred embodiment of the invention, and in which.

DETAILED DESCRIPTION OF THE PREFERRED EMBODIMENT

Figure 1:
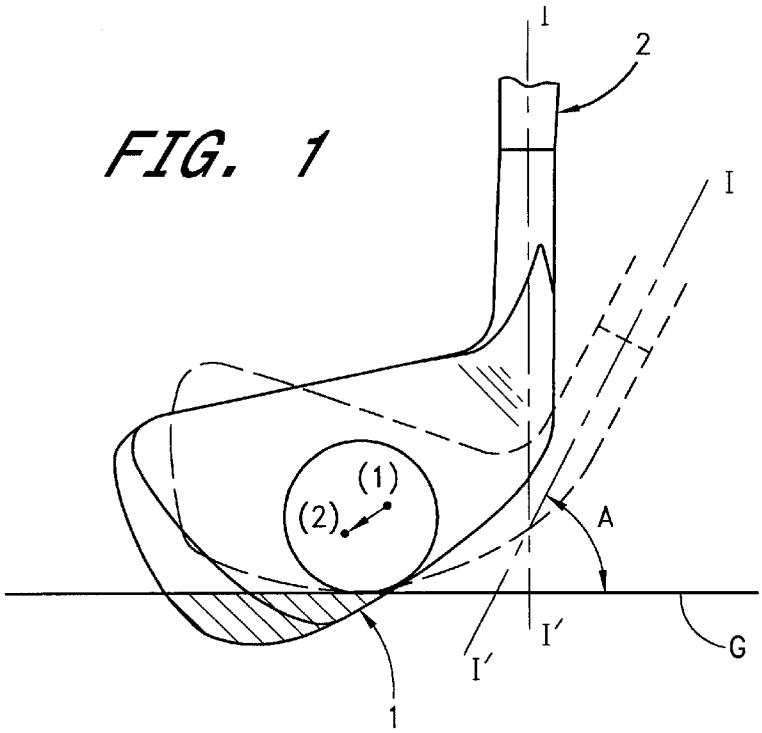
FIG. 1 is a front view illustrating the relative position of a golf ball with a conventional iron-type head in phantom and a "drooped" oversized iron-type head in solid line.
Figure 2:
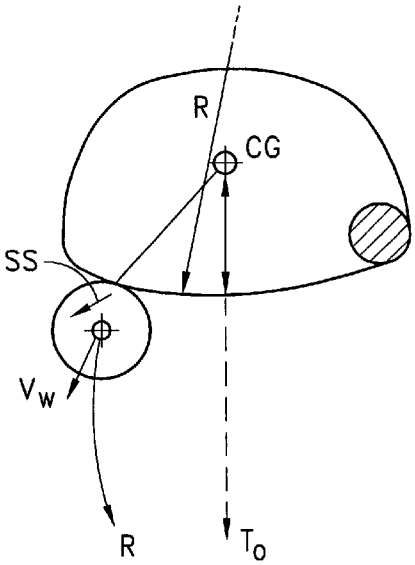
FIG. 2 is a schematic plan view of a wood type head hitting a ball at the toe of the impact face.
Figure 3:
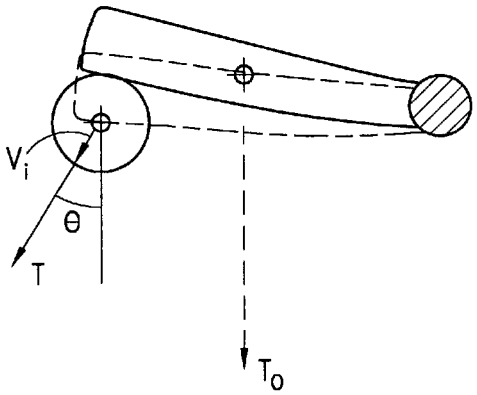
FIG. 3 is a schematic plan view of an oversized iron-type head hitting a ball at the toe of the impact face.
Figure 4:
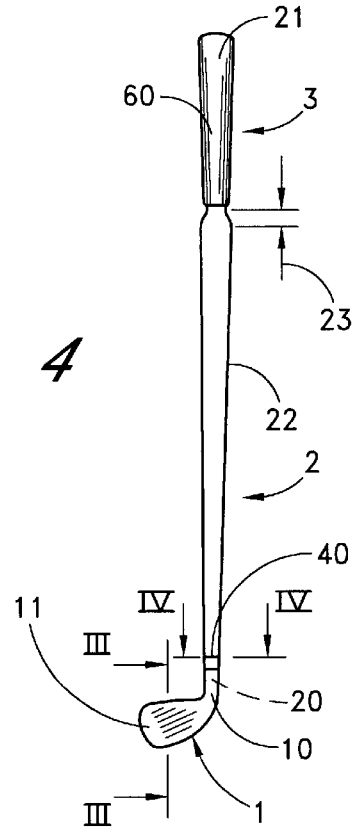
FIG. 4 is a perspective view of a preferred embodiment of a golf club of the present invention.

FIG. 4 shows a golf club having an iron-type head 1 which defines a hosel extension 10 which projects upwardly and defines an opening, a shaft 2 whose tip end 20 (FIG. 5) is positioned within the hosel 10 and a grip 3 which covers the butt end 21 of the shaft.

The shaft 2 is comprised of three portions: the butt portion 60, the main body portion 22, and the tip portion 40. Preferably, the main body portion 22 is of frustroconical shape which is enlarged with respect to a conventional shaft so as to lighten the shaft 2 while keeping an appropriate stiffness distribution. Desirably, the butt portion 60 and the main body portion 22 are connected by a short section 23 having a radius which decreases progressively in the direction of the butt end 21 until the short section 23 mates with the butt portion 60. The butt portion 60 desirably tapers progressively outward toward the butt end 21 so as to receive the preferably thin grip 3. The tip portion 40 is desirably cylindrical and forms a substantially straight profile, for ease of manufacture. As will be appreciated by those of skill in the art, however, the shaft geometry is not limited to this preferred example, and one can envision a more conventional shape for the shaft, as, for example, a single, substantially straight, tapered portion.

The shaft is desirably made of a single type of fibers, preferably carbon. Significantly, the shaft, as described, is desirably under 75 grams for regular flex and under 85 grams for stiff or firm flex. This relatively light weight shaft permits the user to generate greater club head speed and, thereby, achieve greater ball velocity.

Figure 5:
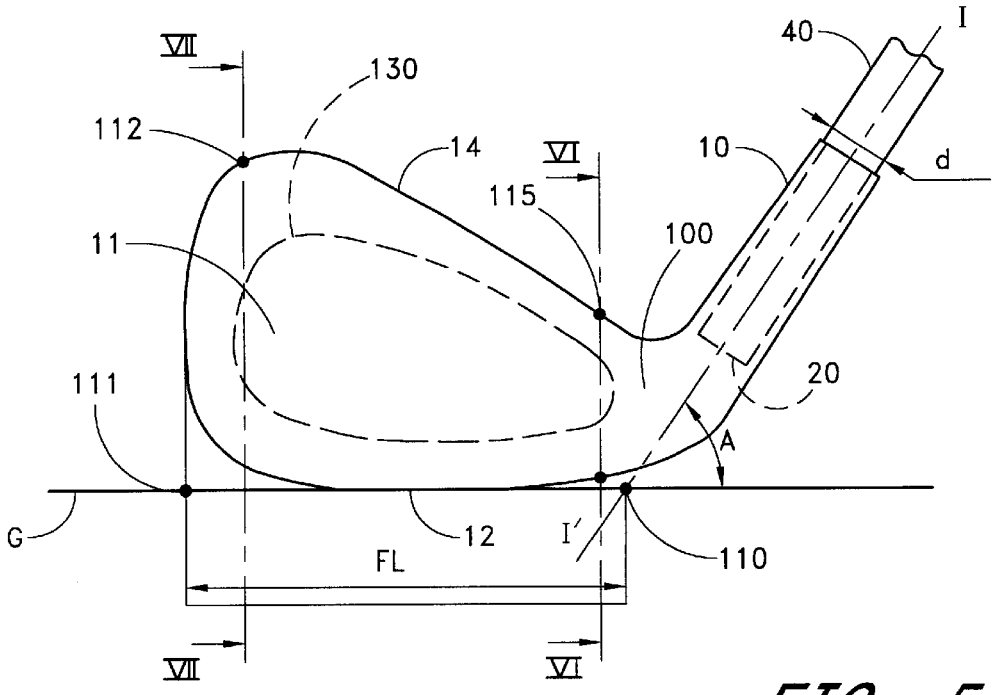
FIG. 5 is a front view of a left-handed oversized iron-type head of a preferred embodiment in the address position on the ground showing a portion of the shaft.

Referring to FIG. 5, the tip portion 40 of the shaft 2 desirably extends into an opening in the hosel 10 so that the tip end 20 of the shaft is secured within the hosel. Advantageously, the tip portion 40 of the shaft 2 just beyond the hosel extension 10 has a diameter d which is larger than is customary for iron-type golf clubs. Advantageously, the diameter d is greater than or equal to 0.38 inches and less than or equal to 0.40 inches (i.e., 0.38 inches$\leqq$d$\leqq$0.40 inches), the advantages of which will be discussed below.

The inside diameter $d_i$ of the tip portion 40 of the shaft measured at the axial location of the tip diameter is desirably at least 0.15 inches. Desirably, the shaft has a wall thickness at the point of emergence of the shaft beyond the hosel 10 between 0.04 and 0.125 inches. The overall length of the shaft is preferably between 33 and 40 inches. By combining these features in a club shaft, the club shaft can be specially designed to create an iron-type club which is more stable in the event of offset impact.

Figure 7:
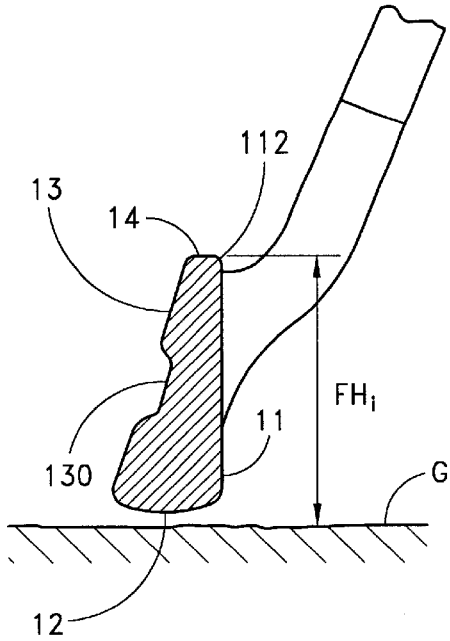
FIG. 7 is a view similar to FIG. 6 but along line VII—VII.
Figure 8:
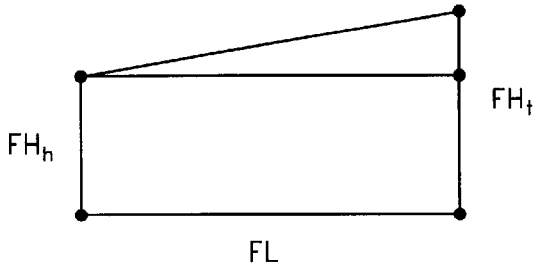
FIG. 8 is a graph illustrating the relationship between the face height and length of the head of FIG. 5, as well as the area of the impact face.
Figure 9:
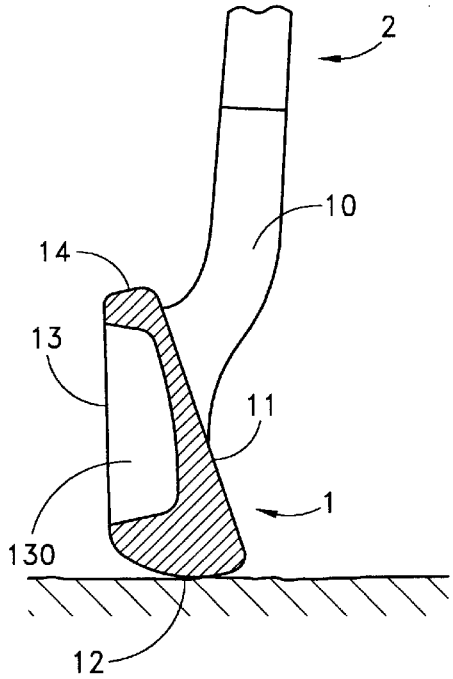
FIG. 9 is a cross-sectional view of the oversized iron-head along III—III of FIG. 4.
Figure 10:
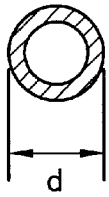
FIG. 10 is a cross-sectional view of the shaft of the golf club along line IV—IV of FIG. 4.

Referring to FIGS. 5 and 7, the head 1 desirably comprises an oversized iron-type head including a flat impact face 11, a slightly rounded sole portion 12, a back portion 13 and a slightly rounded upper edge 14. Preferably, as shown in FIG. 7, the iron-type head 1 defines a central cavity 130 in the back of the head to promote peripheral mass distribution around the cavity and to increase the sweet spot area. The size of the iron heads desirably varies within the set. Normally, the size increases from a long iron to a short iron, with the loft and lie angles increasing as well. The long irons are the 1-iron, the 2-iron, the 3-iron and the 4-iron. The mid irons are the 5-iron, the 6-iron and the 7-iron. The short irons are the 8-iron, 9-iron, pitching wedge and sand wedge.

To obtain a large size head while retaining the standard head mass requirement, the head is desirably made of titanium or titanium alloy. The head can also be made of other materials, such as an aluminum matrix material containing ceramic particles or be made of a combination of a light body and heavy plugs properly located to achieve a high inertia and proper center of gravity location.

Figure 6:
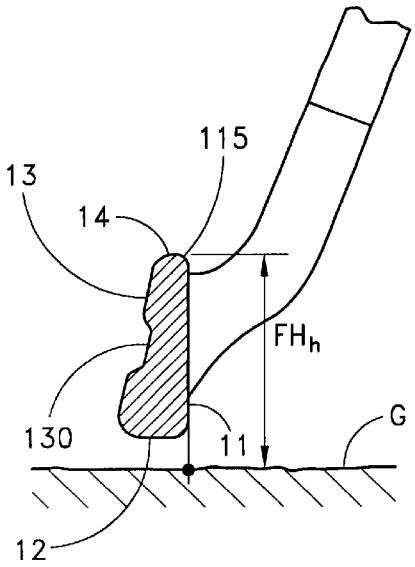
FIG. 6 is a cross-sectional view of the oversized iron-head along line Vi—Vi of FIG. 5 when the head is placed in a position where the face is vertical to the ground.

Desirably, the oversized iron-type head has an effective impact area ($A_{eff}$) which is $\geqq 3200$ mm$^2$. More desirably, the effective area for long irons is $\geqq 3200$ mm$^2$. The effective area for medium irons is $\geqq 3300$ mm$^2$, and the effective area for short irons is $\geqq 3400$ mm$^2$. FIGS. 5, 6 and 7 illustrate the measurements used to calculate the impact area. The formula for calculating the impact area is as follows:

$$A_{eff}=(F_{Hh})(F_L)+\tfrac{1}{2}(F_L)[F_{Ht}-F_{Hh}]$$

where $F_L$ is the length of the impact face, defined as the distance between the point 110 which is the intersection of the centerline I–I' of the shaft 2 with the plane of the ground G and the point 111 which is the orthogonal projection on the plane of the ground G of the end of the toe of the impact face 11.

$F_{Hh}$ is the distance between the vertical boundary point 115 of the club face at the location the hosel extension 100 merges with the impact face and the ground plane G along a vertical line, as shown in FIG. 6. $F_{Ht}$ is the distance between the top vertical boundary point 112 of the impact face in the toe region and the ground plane G along a vertical line as shown in FIG. 7. It will be appreciated that there are limitations in determining the precise impact area pursuant to the above formula, but the formula provides an approximate value of the actual area.

The preferred golf club has numerous advantages, both in terms of performance and ease of manufacture. As discussed above, the outer diameter d of the shaft at the point of emergence of the shaft from the opening in the hosel is desirably at least 0.38 inches and no more than 0.40 inches. Applicant has determined that if the shaft diameter is less than 0.38 inches, the shaft will bend too much and exhibit a droop effect, when the club is swung in a conventional manner. Further, the club face will twist in response to ball impact, resulting in deviation of the ball trajectory and loss of ball velocity.

If the diameter of the shaft is greater than 0.40 inches, Applicant has determined that the tip portion of the shaft will be too thin to be under 75 grams for a regular flex or to be under 85 grams for a firm flex. In this case, such a thin shaft would have undesirably weaker resistance, and would have a tendency to break at the junction of the shaft with the hosel. Furthermore, if the thickness becomes too small there could be production problems when grinding the tip to properly mate with the hosel.

Figure 12:
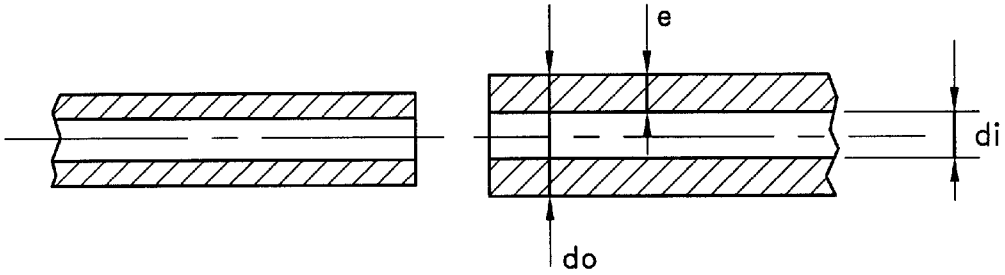
FIG. 12 is a sectional view of a shaft tip of the present invention and a standard shaft tip.

FIG. 12 shows a cross-sectional view of a standard tip section on the left side in comparison with an enlarged tip section on the right side. The standard tip section usually has a diameter of 0.37 inches, in contrast to the tip section of the preferred embodiment which is at least 0.38 inches and no more than 0.40 inches. Enlarging the external diameter ($d_o$) of the shaft tip provides more space inside permitting the thickness (e) of the tip wall to be increased with respect to the standard shaft and consequently it increases the flexional rigidity of the tip portion which is calculated as follows:

$$EI \approx \frac{E(\pi)(d_0^4 - di^4)}{64} \quad \text{(approximation)}$$

where di=internal diameter and E is the effective modulus of the composite material.

The rigidity of the standard diameter shaft (on the left) cannot be increased too much by increasing the thickness of the shaft because the hollow space removed would be too narrow and such a shaft would be difficult to mold by the usual techniques using inside mandrels including cellophane wrapping, internal bladder molding or external bladder autoclave curing.

Figure 13:
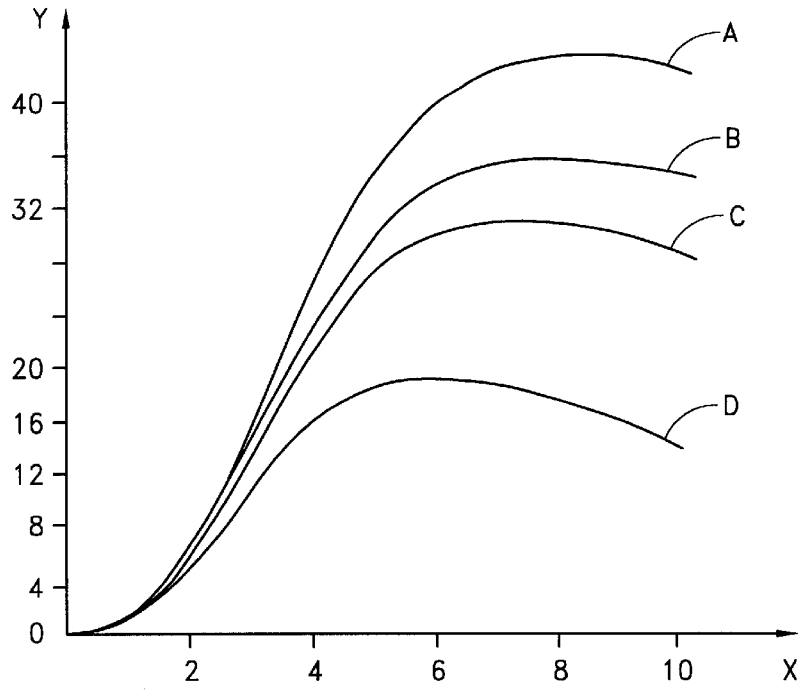
FIG. 13 is a graph illustrating the relationship between time after contact initiation and the rotation of the iron face about a vertical axis for different stiffnesses of shafts.
Figure 14:
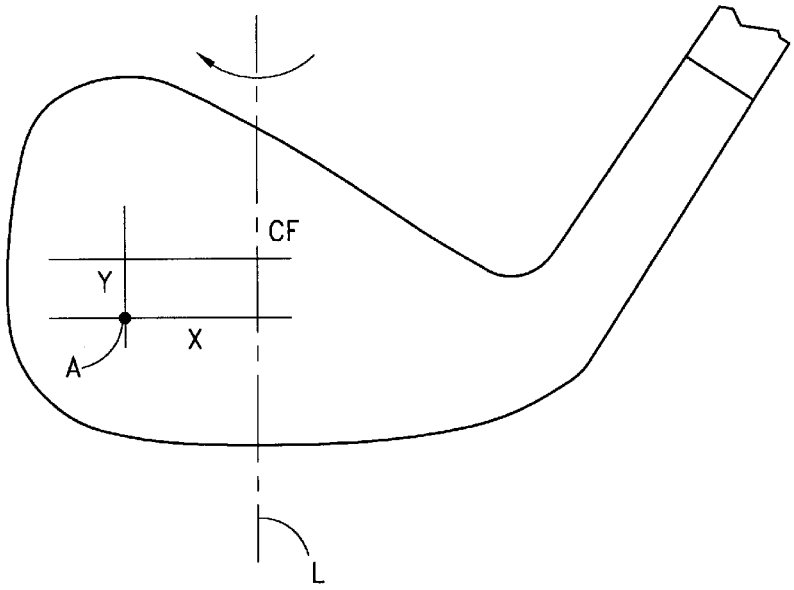
FIG. 14 illustrates the components used to calculate the graph of FIG. 11 in relation to a golf club.

Significantly, the preferred shaft also has enhanced resistance to rotation due to the impact of the ball on the face of the club. FIG. 13 is a graph of the rotation of an iron-type head (indicated in the Y-axis) in milliradians as a function the time of impact of the ball against the face (indicated in X-axis) in milliseconds (ms) for four types of golf clubs. FIG. 14 shows the point of contact A with respect to the center face (CF) during the test of FIG. 13. Point 4 is distant horizontally from center face by X=20 mm and vertically by Y=10 mm.

Curve A corresponds to a standard EI shaft. Curve B corresponds to an enlarged shaft with an EI of 50% or higher than the standard shaft in the tip portion., Curve C corresponds to an enlarged shaft with an increase of 200% of the EI in the tip portion and curve D corresponds to an enlarged shaft with an increase of 500% of the EI in the tip portion. The average time of contact of the ball against the face of impact is approximately 0.5 ms. The average flexional rigidity of the standard shaft measured is approximately $3\times10^7$ Nmm$^2$.

The following table gives the rotation values in each case:

| | Ref. | Rotation at 0.6 ms (in Rad.) | Reduction of rotation (in %) |
|---|---|---|---|
| Prior Art | A | 39.7 | — |
| Invention | B | 34.2 | 14.0 |
| Invention | C | 30.4 | 23.5 |
| Invention | D | 19.2 | 51.7 |

A similar study was performed to evaluate the influence of the torsional stiffness of the shaft tip region on the head rotation for off-center hits. The results were counter-intuitive in that a similar increase in torsional stiffness to that of the above bending stiffness results showed a negligible influence on head rotation.

As discussed above, the tip portion 40 desirably has a substantially straight profile facilitating the ease of manufacture of the club. Advantageously, this permits a single shaft to be manufactured for a variety of clubs, with the tip portion of the shaft being cut an appropriate amount for the number of the iron. For example, a single size shaft could be formed for use on both an 8-iron and a 9-iron, with the only difference being that the shaft for the 9-iron is shortened from the length of the shaft for the 8-iron.

For ease of manufacture, the shaft is preferably constructed out of a single type of fiber. Preferably, this fiber is carbon. This provides for reduced material handling and inventory costs as compared with shafts constructed out of multiple materials. The carbon is advantageous, in that it has a high strength-to-weight ratio, in contrast to other materials such as fiberglass.

The shaft is preferably made entirely of carbon fibers so as to optimize as much as possible the weight/stiffness ratio. Preferably, carbon fibers with standard modulus of elasticity are used. Fiberglass is avoided in the tip area since it increases the weight of the shaft without significant contribution on the mechanical properties of the shaft. Another approach to increase the bending stiffness is to utilize ultra high modulus fibers instead of the standard modulus fibers but this approach is less efficient because (1) the bending stiffness increases in proportion to diameter cubed and only increases linearly with the effective modulus, (2) the ultra high modulus fibers have less breakage resistance than standard modulus fibers and (3) the ultra high modulus fibers are significantly more expensive than the standard modulus fibers. Ultra high modulus fibers are considered being approximately greater than or equal to $60\times10^6$ psi and the standard modulus fibers are between 30 to $60\times10^6$ psi.

Figure 11:
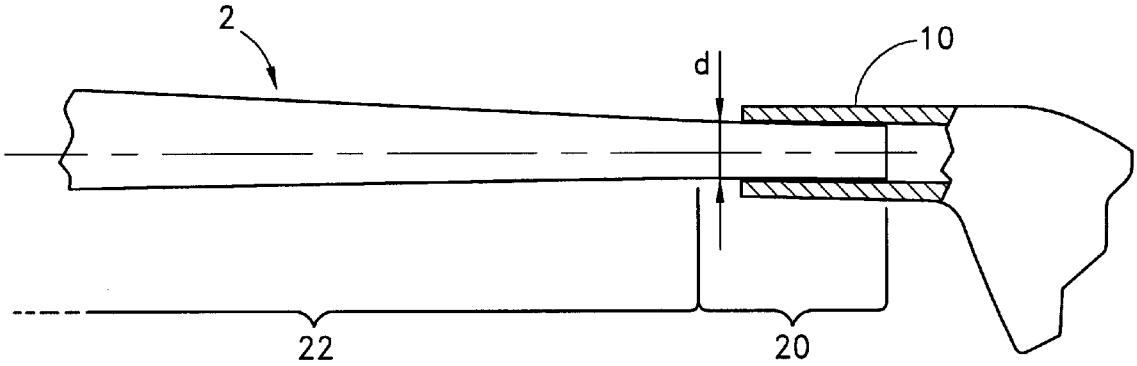
FIG. 11 is a partial sectional view of the intersection of the club head with the shaft.

As shown in FIG. 11, the tip portion 20 of the shaft is preferably a cylindrical portion along a certain length in order to fit properly within the cylindrical opening of the hosel extension 10. The cylindrical portion gives the possibility to match the same shaft to the different iron heads within the set just by cutting the tip end in the cylindrical region in order to adjust the length of the shaft as it is usual that the shaft length becomes shorter as the number becomes higher within the set.

It is understood that while certain forms of the present invention have been illustrated and described herein, it is not to be limited to the specific forms or arrangements of parts described and shown.

What is claimed is:

1. A golf club, comprising:

an iron-type head defining a sole portion, an impact face, a back portion and a hosel extension defining an opening; and a shaft having a shaft length between 33 to 40 inches, said shaft comprising a butt portion and a tip portion, said tip portion having a substantially straight profile, an outer diameter, an inner diameter and wall thickness defined by both said outer and inner diameter;

said outer diameter of the tip portion being greater than or equal to 0.38 inches and less than or equal to 0.40 inches, said inner diameter of the tip portion being greater than or equal to 0.15 inches;

said wall thickness of the tip portion being between 0.04 and 0.125 inches.

2. The golf club of claim 1, wherein said shaft has a weight less than or equal to 85 grams.

3. The golf club of claim 2, wherein said tip portion has a flexional rigidity in the range of range of $4.5\times10^7$ N-mm$^2$ to $15\times10^7$ N-mm$^2$.

4. The golf club of claim 2, wherein said fibrous material comprises carbon fibers having a modulus of elasticity between $30\times10^6$ psi and $60\times10^6$ psi.

5. The golf club of claim 2, wherein said head is an oversize iron-type head defining an impact face having an area of greater than or equal to 3200 mm2.

6. The golf club of claim 5, wherein said tip portion has a length of greater than or equal to 2 and less than or equal to 11 inches.

7. The golf club of claim 5, wherein said head is a long iron type head.

8. The golf club of claim 5, wherein said head is a medium iron type head defining an impact face having an area of greater than or equal to 3300 mm2.

9. The golf club of claim 5, wherein said head is a short iron type head defining an impact face having an area of greater than or equal to 3400 mm2.

* * * * *